US010186366B2

(12) United States Patent
Lee et al.

(10) Patent No.: US 10,186,366 B2
(45) Date of Patent: Jan. 22, 2019

(54) ELECTRODE STRUCTURE AND THE CORRESPONDING ELECTRICAL COMPONENT USING THE SAME AND THE FABRICATION MERHOD THEREOF

(71) Applicant: CYNTEC CO., LTD., Hsinchu (TW)

(72) Inventors: Chih-Sun Lee, Hsinchu (TW); Cheng-Chang Lee, Hsinchu (TW); Yi-Wei Chen, Hsinchu (TW)

(73) Assignee: CYNTEC CO., LTD., Hsinchu (TW)

( * ) Notice: Subject to any disclaimer, the term of this patent is extended or adjusted under 35 U.S.C. 154(b) by 373 days.

(21) Appl. No.: 14/630,665

(22) Filed: Feb. 25, 2015

(65) Prior Publication Data

US 2015/0325364 A1 Nov. 12, 2015

Related U.S. Application Data

(60) Provisional application No. 61/990,735, filed on May 9, 2014.

(51) Int. Cl.

| | |
|---|---|
| ***H01F 17/04*** | (2006.01) |
| ***H01F 27/02*** | (2006.01) |
| ***H01F 27/29*** | (2006.01) |
| ***H01F 41/12*** | (2006.01) |
| ***H01F 41/10*** | (2006.01) |
| *H01F 27/28* | (2006.01) |

(52) U.S. Cl.

CPC ..... *H01F 27/292* (2013.01); *H01F 17/045* (2013.01); *H01F 41/10* (2013.01); *H01F 41/12* (2013.01); *H01F 27/2847* (2013.01); *Y10T 29/49075* (2015.01)

(58) Field of Classification Search

None

See application file for complete search history.

(56) References Cited

U.S. PATENT DOCUMENTS

| | | | | |
|---|---|---|---|---|
| 4,498,067 | A * | 2/1985 | Kumokawa | H01F 5/00 336/192 |
| 4,926,151 | A * | 5/1990 | Morinaga | H01F 17/045 335/296 |
| 6,437,676 | B1 * | 8/2002 | Takeda | H01F 17/062 336/192 |
| 6,535,095 | B2 * | 3/2003 | Aoki | H01F 17/045 336/200 |
| 7,215,232 | B2 * | 5/2007 | Aoki | H01F 17/045 336/83 |

* cited by examiner

*Primary Examiner* — Ronald Hinson

(74) *Attorney, Agent, or Firm* — Min-Lee Teng; Litron Patent & Trademark Office

(57) ABSTRACT

An electrical component is disclosed, wherein the electrical component comprises: a body and an electrode structure disposed on a first surface of the body, wherein the electrode structure comprises an inner metal layer and an outer metal layer, wherein a terminal of a conductive element of the electrical component is disposed between the inner metal layer and the outer metal layer, wherein the terminal of the conductive element of the electrical component is electrically connected to the inner metal layer and the outer metal layer for electrically connecting with an external circuit.

15 Claims, 14 Drawing Sheets

ELECTRODE STRUCTURE AND THE CORRESPONDING ELECTRICAL COMPONENT USING THE SAME AND THE FABRICATION MERHOD THEREOF

CROSS-REFERENCES TO RELATED APPLICATIONS

This application claims the benefit of U.S. Provisional Patent Application No. 61/990,735 filed on May 9, 2014, which is hereby incorporated by reference herein and made a part of specification.

BACKGROUND OF THE INVENTION

I. Field of the Invention the present invention relates to an electrical component, and in particularly, to the electrodes of the electrical component.

II. Description of the Prior Art

As an electrical component or an electronic device becomes smaller and smaller, the size and the reliability of the electrode structure becomes a bottleneck considering the electrical performance and the reliability of the electrical component. The electrodes are used to connect the electrical component to an external circuit such as a printed circuit board (PCB), and terminals of the conductive elements of the electrical component are electrically connected to corresponding electrodes such as surface-mount pads for soldering onto the corresponding pads on the PCB. A lead frame is usually welded to the terminals of the electrical component; however, the size of the lead frame normally takes quite a large space for an electrical component in a small foot print and therefore, the lead frame is not suitable for being used as an electrode for certain electrical components or electronic devices that requires a smaller size.

Surface Mount Technology (SMT) is a feasible way to reduce the overall size of an electrical component or an electronic device, such as a resistor, a capacitor or an inductor. However, as the overall size of the electrical component becomes smaller and smaller, how to make the surface-mount pads reliable in both mechanic and electrical aspects is a very important topic. The resistance of an electrode created by conventional electroplating may vary very much, which degrades electrical performance in certain applications or even affect the yield rate of the electrical components in manufacturing factory. On the other hand, chemical plating can cause a short circuit when the material of the plating spreads into certain unwanted areas.

Accordingly, the present invention proposes an electrode structure to overcome the above-mentioned problems.

SUMMARY OF THE INVENTION

One objective of the present invention is to provide a circuit module for connecting to a circuit board or a motherboard by using surface-mounting pads on a lateral surface of the circuit module so as to reduce the connecting space between the circuit module and the circuit board.

In one embodiment, an electrical component is disclosed, wherein the electrical component comprises: a body and an electrode structure disposed on a first surface of the body, wherein the electrode structure comprises an inner metal layer and an outer metal layer, wherein a terminal of a conductive element of the electrical component is disposed between the inner metal layer and the outer metal layer, wherein the terminal of the conductive element of the electrical component is electrically connected to the inner metal layer and the outer metal layer for electrically connecting with an external circuit.

In one embodiment, a first surface of the inner metal layer contacts the outer metal layer, wherein the inner metal layer comprises a structure on a second surface of the inner metal layer opposite to the first surface of the inner metal layer, wherein the structure is embedded inside the body for connecting the inner metal layer with the body of the electrical component.

In one embodiment, the structure of the inner metal layer is in a saw-tooth form.

In one embodiment, the electrical component is an inductor, wherein the body comprises a magnetic core and the conductive element is a coil, wherein the coil surrounds the magnetic core.

In one embodiment, the magnetic core is a T-core having a pillar, wherein the coil surrounds the pillar.

In one embodiment, the inner metal layer is a portable metal pad.

In one embodiment, the thickness of the inner metal layer is less than or equal to 100 um; in one embodiment, the thickness of the inner metal layer is between 3 um and 150 um. In one embodiment, the inner metal layer is a metal foil, wherein the thickness of the metal foil is less than or equal to 100 um; in one embodiment, the thickness of the metal layer is between 3 um and 150 um.

In one embodiment, the inner metal layer is a metal foil, wherein the metal foil is one of the following: a copper foil, a gold foil, a tin foil and an aluminum foil.

In one embodiment, the inner metal layer is a RCC (Resin Coated Copper) layer, wherein the RCC (Resin Coated Copper) layer is resin cured on the first surface of the body.

In one embodiment, the electrode structure further comprising an adhesive layer under the inner metal layer for connecting the inner metal layer with the first surface of the body.

In one embodiment, the adhesive layer comprises adhesive material such as glue, epoxy resin or any other suitable adhesive material.

In one embodiment, the outer metal layer comprises tin. In one embodiment, the outer metal layer comprises tin, cu, ag or any suitable conductive materials.

In one embodiment, a method to form an electrode structure of an electrical component is disclosed, wherein the method comprises: fixing an inner metal layer with a first surface of the body; disposing a terminal of a conductive element on the inner metal layer; and disposing an outer metal layer on the terminal of the conductive element and the inner metal layer.

In one embodiment, the body is a magnetic core and the conductive element is a coil, wherein the terminal of the coil is disposed on the first surface of the metal layer.

In one embodiment, the inner metal layer is fixed on the first surface of the body by adhesive material;

In one embodiment, the inner metal layer is a RCC (Resin Coated Copper) layer, wherein the RCC (Resin Coated Copper) layer is resin cured on the first surface of the body.

In one embodiment, the thickness of the metal layer is between 3 um and 150 um. In one embodiment, the thickness of the metal layer is between 3 um and 100 um.

In one embodiment, the inner metal layer comprises a structure on a second surface of the inner metal layer, wherein the structure is embedded inside the body for connecting the inner metal layer with the body of the electrical component.

In one embodiment, a method to form an electrode structure is disclosed, wherein the method comprises: providing a first metal layer having a structure on a first surface of the first metal layer; forming a body on the first surface of the first metal layer, wherein the structure is embedded inside the body and a second surface of the first metal layer opposite to the first surface is used for forming an electrode.

In one embodiment, the structure is in a saw-tooth form.

In one embodiment, the method further comprising disposing a terminal of a conductive element on the first metal layer; and disposing a second metal layer on the terminal of the conductive element and the first metal layer.

In one embodiment, an inductive component is disclosed, wherein inductive component comprises: a magnetic body, a coil encapsulated by the magnetic body and a first electrode structure disposed on a first surface of the magnetic body, wherein the first electrode structure comprises a first inner metal layer and a first outer metal layer, wherein a first terminal of the coil is disposed between the first inner metal layer and the first outer metal layer, wherein the first terminal of the coil is electrically connected to the first inner metal layer and the first outer metal layer for electrically connecting with an external circuit.

In one embodiment, the magnetic body comprises a T-core and the coil surrounds a pillar of the T-core.

The detailed technology and above preferred embodiments implemented for the present invention are described in the following paragraphs accompanying the appended drawings for people skilled in this field to well appreciate the features of the claimed invention.

BRIEF DESCRIPTION OF THE DRAWINGS

The foregoing aspects and many of the accompanying advantages of this invention will become more readily appreciated as the same becomes better understood by reference to the following detailed description when taken in conjunction with the accompanying drawings, wherein.

DETAILED DESCRIPTION OF THE INVENTION

The detailed explanation of the present invention is described as following. The described preferred embodiments are presented for purposes of illustrations and description, and they are not intended to limit the scope of the present invention.

The following embodiments disclose an electrical component, wherein the electrical component comprises: a body and an electrode structure disposed on a first surface of the body, wherein the electrode structure comprises an inner metal layer and an outer metal layer, wherein a terminal of a conductive element of the electrical component is disposed between the inner metal layer and the outer metal layer, wherein the terminal of the conductive element of the electrical component is electrically connected to the inner metal layer and the outer metal layer for electrically connecting with an external circuit.

Figure 1:
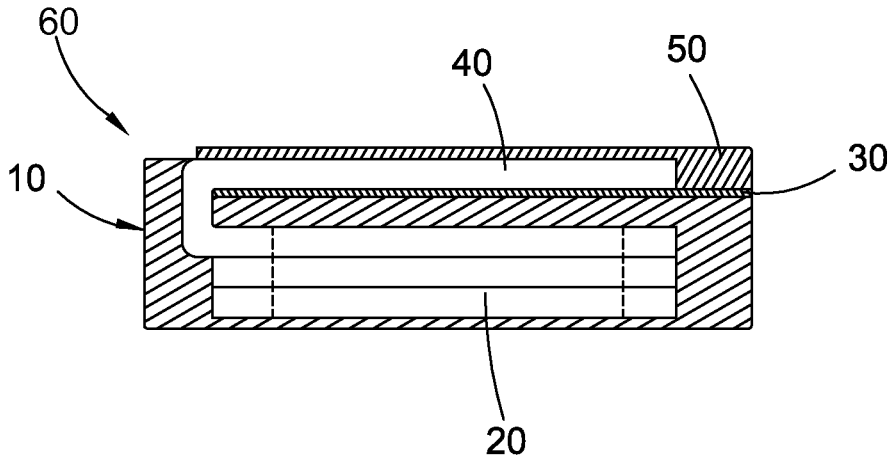
FIG. 1 illustrates a cross-sectional view of an electrode structure of an electrical component according to an embodiment of the present invention.

Please refer to FIG. 1, which illustrates a cross-sectional view of an electrode structure of an electrical component according to an embodiment of the present invention. The electrode structure can be used to electrically connect terminals 40 of conductive elements of the electrical component with an external circuit such as a printed circuit board (PCB). In one embodiment, the electrical component comprises: a main body 10, an inner metal layer 30 and an outer metal layer 50, wherein the outer metal layer 50 can also be called an electrode layer for connecting with the external circuit. The inner metal layer 30 is disposed on a surface of the main body 10 and a terminal 40 of a conductive element of the electrical component 60 is disposed on the inner metal layer 30. The outer metal layer 50 is disposed on inner metal layer 30 and the terminal 40 of the conductive element of the electrical components 60 so as to form an electrode for connecting with the external circuit such as a PCB.

In one embodiment, the inner metal layer 30 can be a plated metal layer, which can be formed on the surface of the body 10 of the electrical component 60 by electroplating, immersion or chemical plating, or a portable metal pad, which can be attached to the surface of the body of the electrical component by adhesive materials. The plated metal layer can be formed by electroplating, immersion plating and chemical plating on either surface of the body 10.

In one embodiment, the portable metal pad is a metal foil which is fixed to the surface of the body of the electrical component by adhesive materials or by pressing with a pressure. In one embodiment, the metal foil is one of the following: a copper foil, a gold foil, a tin foil a silver foil, an aluminum foil or a foil made of alloy such as Cu and Ni or phosphor bronze. In one embodiment, the thickness of the metal foil is less than or equal to 100 um.

In one embodiment, the material of the outer metal layer 50, or the electrode layer, comprises tin or tin-nickel alloy or any other suitable material. In one embodiment, the outer metal layer 50 comprises a conductive paste for connecting with the inner metal layer and the terminal 40 of the conductive element so as to make sure they are firmly connected. The conductive paste can be a polymer containing silver powder, which can be printed or coated on the top surface of the inner metal layer 30.

FIG. 1 illustrates an electrode structure according to one embodiment of the present invention, wherein the inner metal layer 30 is a plated metal layer. A manufacturing process to form the electrode structure in FIG. 1 is described below. First, the inner metal layer 30 is formed on the surface of the body 10 by plating such as electroplating, immersion or chemical plating. Next, the terminal 40 of the conductive element of the electrical component 60 is fixed to the upper surface of the inner metal layer 30 by using adhesive materials or spot soldering. In one embodiment, the terminal 40 has a bending portion for allowing the terminal to be disposed on the surface of the body 10. Then, the outer metal layer 50 is formed on the top surface of the inner metal layer 30 so as to cover the terminal 40 and the inner metal layer 30. By electrically connecting the outer metal layer 50, the inner metal layer 30 and the terminal 40, an electrode structure of the electrical component is formed for electrically connecting with the external circuit.

In an embodiment, a manufacturing process of the electrode structure as described above further comprises: removing the insulating material that encapsulates the terminal 40. For example, the conductive element of the electrical component 60 is a coil which is formed by enameled wire, and the insulating material encapsulating the internal conductor wire can be removed by laser, for example, to expose the internal conductor for electrically connecting the terminal 40 with the inner metal layer and the outer metal layer.

In one embodiment, the electrical component 60 can be an inductor, a capacitor, a resistor, a transistor. In one embodiment, the electrical component 60 can be a chip or a module. For example, the electrical component 60 depicted in FIG. 1 is an inductor or a choke, and the electrode structure of the manufacturing process of the inductor, or the choke, will be described as below, along with the FIG. 2A~FIG. 2F. In one embodiment, the thickness of the inner metal layer is less than or equal to 100 um; in one embodiment, the thickness of the inner metal layer is between 3 um and 150 um.

Figure 2A:
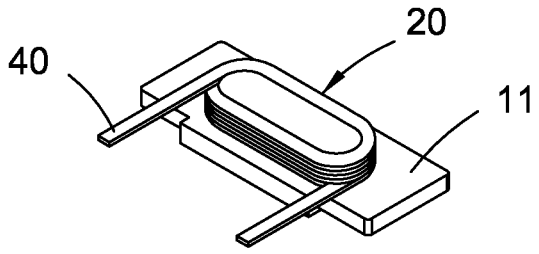
FIGS. 2A~2E illustrates an electrode structure and the fabrication method of an inductor, or the choke.
Figure 2B:
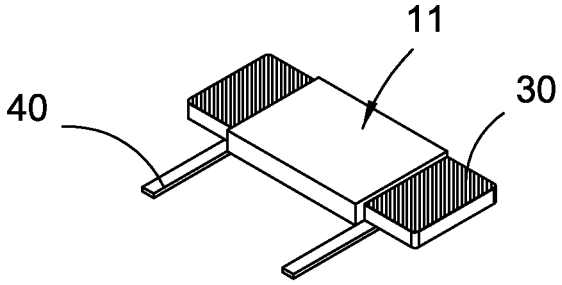
Figure 2C:
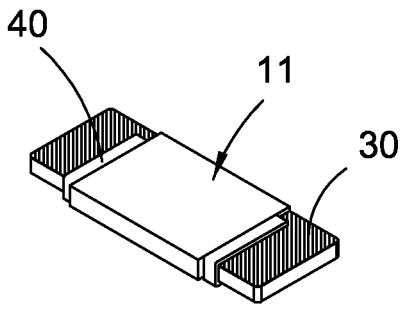
Figure 2D:
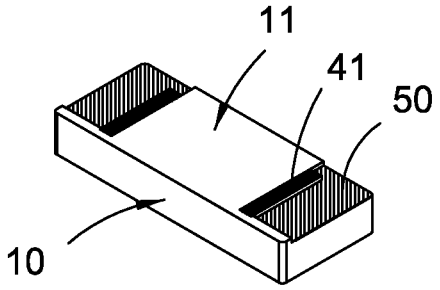

Firstly, providing a first body 11 and a coil 20, which is formed by winding an enameled wire on the body 11, as shown in FIG. 2A. In one embodiment, the first body 11 is a T-core for making an inductor or a choke. Then, an inner metal layer 30 is formed on a surface of the first body 11 by plating such as electroplating, immersion or chemical plating, as shown in FIG. 2B. Next, the terminal 40 of the conductive element of the electrical component 60 is fixed to the upper surface of the inner metal layer 30 by using adhesive materials or spot soldering. In one embodiment, the terminal 40 has a bending portion for allowing the terminal to be disposed on the surface of the body 10, as shown in FIG. 2C.

Figure 2E:
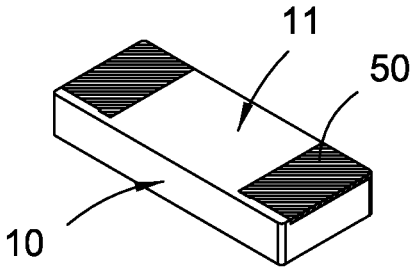

The first body 11, the coil 20 and magnetic powders are integrally formed to become the main body 10 of the electrical components 60. Next, removing the insulating material of the enamel wire containing the terminal 40 to expose the metal portion 41 as shown in shaded portion in FIG. 2D. Then, forming the electrode layer 50 on the top surface of the inner metal layer 30 as an electrode layer, as shown in FIG. 2E. The electrode layer 50 covers the terminal 40 and the inner metal layer 30. Since the upper surface of the enamel layer of the terminal 40 has been removed, the electrode layer 50 is electrically connected to the inner metal layer 30 and the terminal 40, thereby forming an electrode structure. In one embodiment, the terminal 40 is a flat conductor wire.

Figure 3:
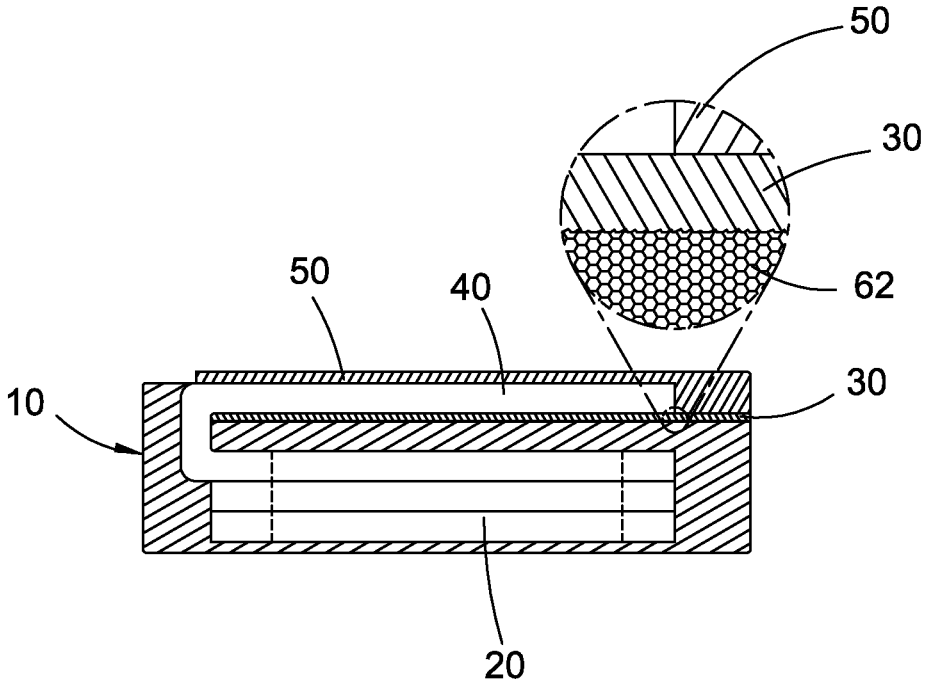
FIG. 3 illustrates a cross-sectional view and a fabricating process of an electrode structure according to another embodiment of the present invention.

Please refer to FIG. 3, which illustrates a cross-sectional view and a fabricating process of an electrode structure according to another embodiment of the present invention, wherein the inner metal layer 30 is a portable metal pad; the method for fabricating the electrode structure of FIG. 3 is described below. First, a metal foil is provided. Next, the metal foil is bonded to a surface of the main body 10 to from the inner metal layer 30 on the surface of the body 10. Then, a terminal 40 of a conductive element of the electrical component 60 is fixed to the top surface of the inner metal layer 30. Then, an outer metal layer or an electrode layer 50 is formed on the top surface of the inner metal layer 30 to cover the inner metal layer 30 and the terminal 40 of a conductive element of the electrical component 60.

Figure 4A:
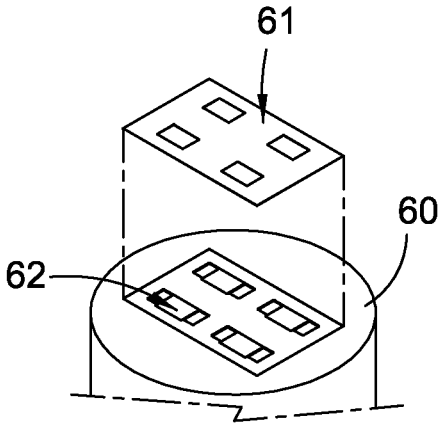
FIGS. 4A~4H illustrates a manufacturing process of the electrode structure in FIG. 3.
Figure 4B:
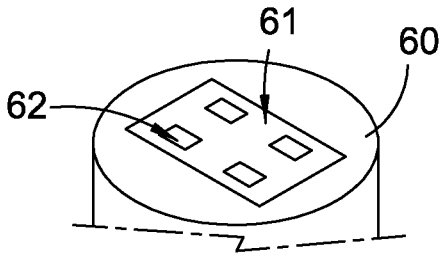

Please refer to FIG. 4A~FIGS. 4H and 5A and 5B, which illustrates a portable metal pad formed on the body of a miniature inductor; a method to form a portable metal pad on the body of a miniature inductor is described below. First, a mold 60 and a metal foil 61 (e.g., copper foil) are provided, and magnetic powder material 62 is filled in the mold 60 for forming the first body 11, as shown in FIG. 4A. The metal foil 61 is placed in a predetermined position of the mold 60, as shown in FIG. 4B.

Figure 4C:
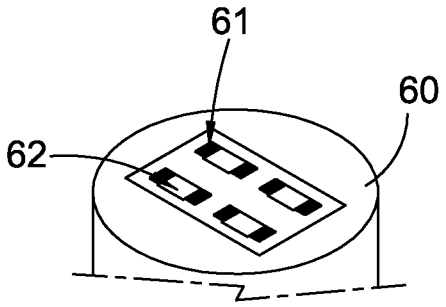
Figure 4D:
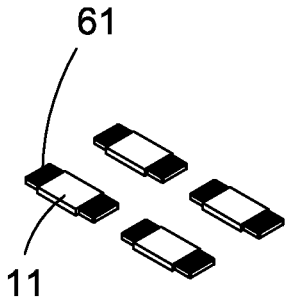
Figure 4E:
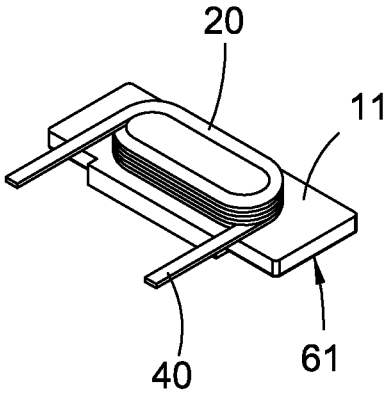
Figure 4F:
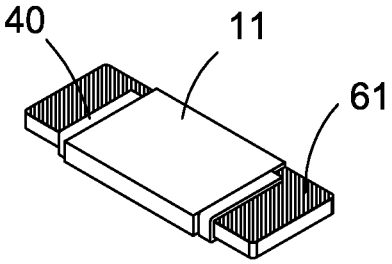
Figure 4G:
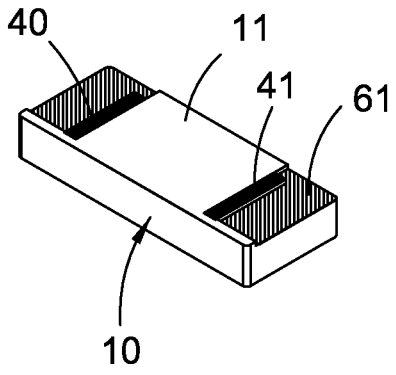
Figure 4H:
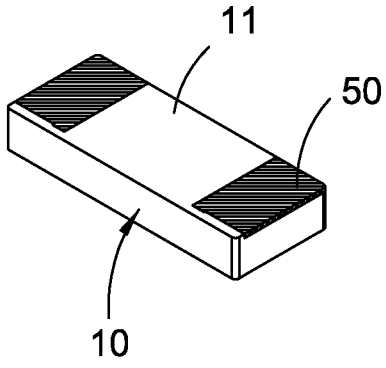
Figure 5A:
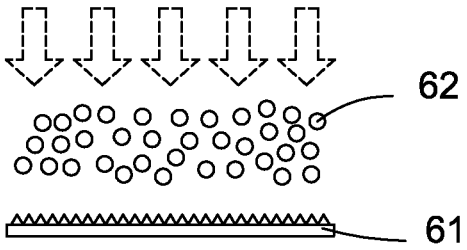
FIGS. 5A~5B illustrates a method to bond a metal foil on which powders are molded on the metal foil to form a body of an electrical component.
Figure 5B:
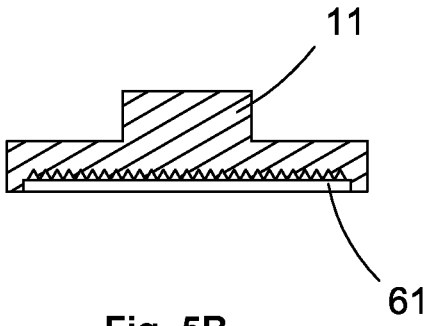

Then, a molding and pressing process is performed on the magnetic powder material 62 so as to form the first body 11, wherein the metal foil 61 is punched into a desired size and shape as shown in FIG. 4C, wherein the metal foil 61 has a rough structure in one surface which is bonded to magnetic powder by the pressure, as shown in FIG. 5A and FIG. 5B. Afterward, the first body 11 that has been molded is removed from the mold 11, wherein the metal foil 61 has been bonded to the surface of the first body 11, as shown in FIG. 4D. Then, winding a wire on the first body 11 to form the coil 20 of the inductor, as shown in see FIG. 4E. The terminal 40 of the coil is bent and fixed to the upper surface the metal foil 61, as shown in FIG. 4F. A molding process is performed so that the first body 11 and the coil 20 together with magnetic powders are integrally formed as the main body 10 of the electrical component 60. Then, the outer insulating layer of the enamel wire of the terminal 40 is removed, as shown in FIG. 4G. Then, an outer metal layer (electrode layer) 50 is overlaid on the top surface of the metal foil 61 by spot soldering so as to form an electrode of the electrical component 60, as shown in see FIG. 4H, wherein the terminal 40 is disposed between the metal foil 61 and the electrode layer 50 for connecting with an external circuit such as a PCB.

Figure 6:
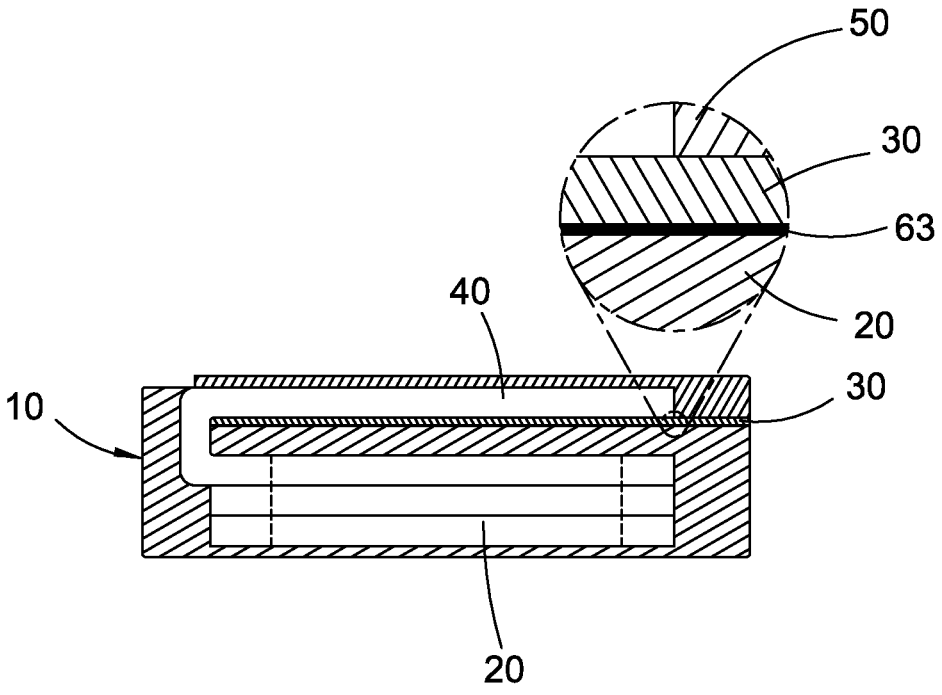
FIG. 6 illustrates a cross-sectional view of an electrode structure of an electrical component according to another embodiment of the present invention.

Please refer to FIG. 6, which illustrates a cross-sectional view and a fabrication method of an electrode structure according to yet another embodiment of the present invention. As shown in FIG. 6, the inner metal layer 30 is a metal foil which is attached to the surface of the body 10 by an adhesive layer 63 which comprises thermosetting resin such as epoxy resin. In one embodiment, as shown in FIGS. 7A~7F, the inner metal layer is a RCC (Resin Coated Copper) foil 64, wherein the RCC (Resin Coated Copper) foil is resin cured on the surface of the body 10. In one embodiment, the thickness of the RCC (Resin Coated Copper) foil 64 is between 3 um and 150 um. The manufacturing method of the electrode structure on the body 10 of the miniature inductor in FIG. 6 will be described below, along with FIGS. 7A~7E.

Figure 7A:
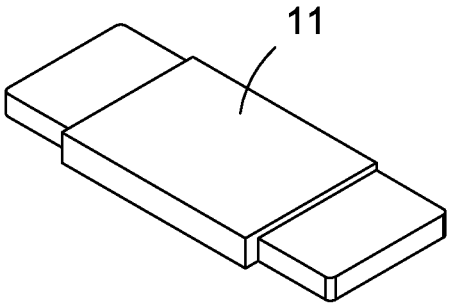
FIGS. 7A~7F illustrates a manufacturing process of the electrode structure in FIG. 6.
Figure 7B:
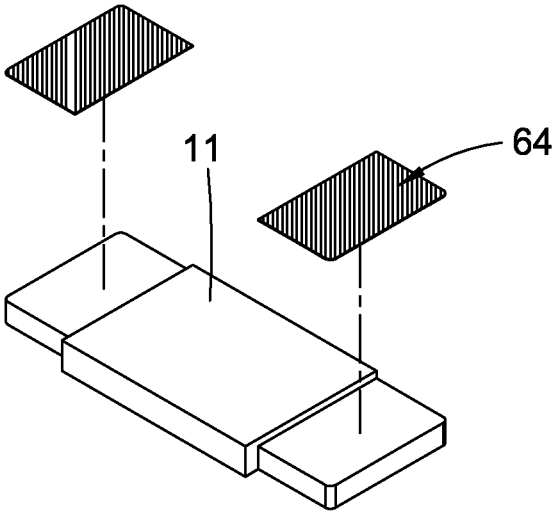

First, a molding process is performed on the magnetic powders so as to form a first body 11, as shown in FIG. 7A. In parallel, a RCC (Resin Coated Copper) foil 64 can be formed, wherein the RCC (Resin Coated Copper) foil 64 can be formed in a desired size and shape based on the design requirements. The RCC (Resin Coated Copper) foil 64 is attached to a surface of the first body 11 at a predetermined position of an electrode, after which a pre-cure process can be performed to resin cure the RCC (Resin Coated Copper) foil 64 on the surface of the first body 11. In one embodiment, the pre-cure process is performed at 80~250° C. with a pressure 0~50 $Kg/cm^2$ to resin cure the RCC (Resin Coated Copper) foil 64 onto the surface of the first body 11, as shown in FIG. 7B.

Figure 7C:
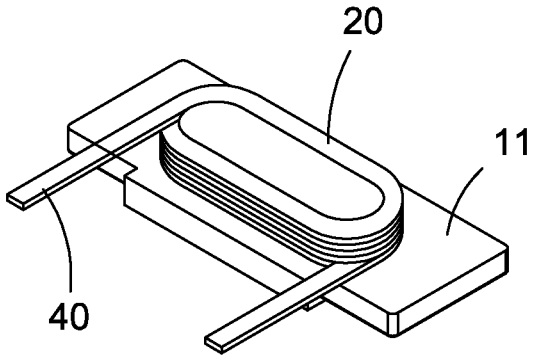
Figure 7D:
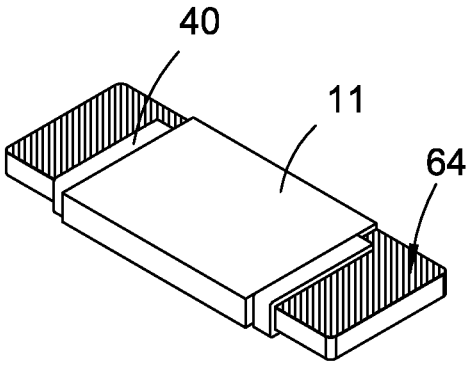
Figure 7E:
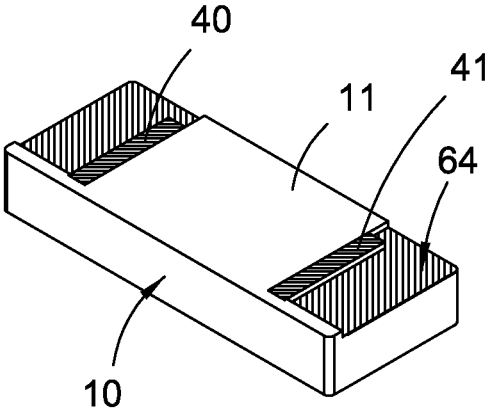
Figure 7F:
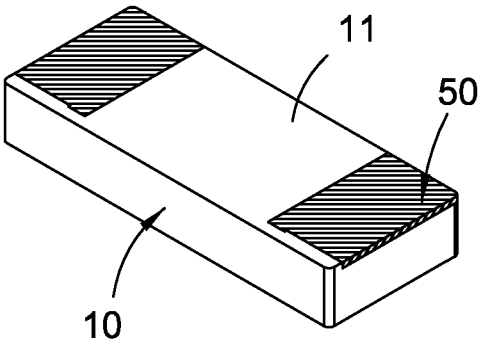

Next, winding a conductor wire, such as enameled wire, on the body 11 to form the coil 20 of the first inductor, as shown in FIG. 7C. FIG. 7C shows the coil 20 view from the bottom surface of the first body 11. The terminal 40 is bent and fixed on the top surface of the RCC (Resin Coated Copper) foil 64, and the outer insulating layer of the enamel wire is removed to expose the internal conductor 41 of the terminal 40, as shown in FIG. 7D. Then, a molding process will be performed on magnetic powders with the first body 11 and the coil 20 so as to form the main body 10 of the electrical component 60, as shown in FIG. 7E. Then, an electrode layer 50 is overlaid on the surface of RCC (Resin Coated Copper) foil 64 to cover the RCC (Resin Coated Copper) foil 64 and the terminal 40, as shown in FIG. 7F.

Please note that the electrode structure of the present invention can be applied to any electrical components, modules, or systems.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. An electrical component, comprising: a magnetic core, wherein a first side of the magnetic core comprises a protrusion portion, a first recess and a second recess, wherein the first recess and the second recess are at two opposite sides of the protrusion portion on the first side of the magnetic core, and each of said recesses respectively has only one sidewall formed by the magnetic core, wherein each said only one sidewall is formed by a corresponding side surface of the protrusion portion, wherein a first electrode structure and a second electrode structure are respectively disposed over the first recess and the second recess, wherein each of the first electrode structure and the second electrode structure comprises a corresponding inner metal layer and a corresponding outer metal layer with a corresponding terminal of a conductive element of the electrical component being disposed therebetween, wherein said corresponding terminal of the conductive element and said corresponding inner metal layer are disposed in a corresponding recess of said recesses, wherein said corresponding terminal of the conductive element of the electrical component is electrically connected to said corresponding inner metal layer and said corresponding outer metal layer for electrically connecting with an external circuit.

2. The electrical component according to claim 1, wherein the electrical component is an inductor or a choke.

3. The electrical component according to claim 1, wherein the electrical component is an inductor, wherein the conductive element is a coil, wherein the coil surrounds a portion of the magnetic core.

4. The electrical component according to claim 1, wherein the magnetic core comprises a plate and a pillar, wherein the protrusion portion and the pillar are formed on two opposite sides of the plate.

5. The electrical component according to claim 1, wherein the corresponding inner metal layer is a metal foil, wherein the metal foil is one of the following: a copper foil, a gold foil, a tin foil, a silver foil, an aluminum foil or an alloy foil.

6. The electrical component according to claim 1, wherein the corresponding inner metal layer is an RCC (Resin Coated Copper) foil, wherein the RCC (Resin Coated Copper) foil is resin cured on the first surface of the core.

7. The electrical component according to claim 1, wherein the corresponding outer metal layer comprises tin.

8. The electrical component according to claim 1, wherein a first surface of the corresponding inner metal layer contacts the corresponding outer metal layer, wherein the corresponding inner metal layer comprises a structure on a second surface of the corresponding inner metal layer opposite to the first surface, wherein the structure is embedded inside the magnetic core for connecting the corresponding inner metal layer with the magnetic core.

9. The electrical component according to claim 8, wherein the structure of the corresponding inner metal layer is in a saw-tooth form.

10. The electrical component according to claim 1, wherein the corresponding inner metal layer is a portable metal pad.

11. The electrical component according to claim 10, wherein the portable metal pad is a metal foil, wherein the thickness of the metal foil is between 3 to 150 um.

12. The electrical component according to claim 1, wherein the first electrode structure further comprising an adhesive layer under the corresponding inner metal layer for connecting the corresponding inner metal layer with the magnetic core.

13. The electrical component according to claim 12, wherein the adhesive layer comprises epoxy resin.

14. An inductive component, comprising:

a magnetic core, wherein a first side of the magnetic core comprises a protrusion portion, a first recess and a second recess, wherein the first recess and the second recess are at two opposite sides of the protrusion portion on the first side of the magnetic core, and each of said recesses respectively has only one sidewall formed by the magnetic core, wherein each said only one sidewall is formed by a corresponding side surface of the of the protrusion portion;

a coil, encapsulated by the magnetic core; and a first electrode structure and a second electrode structure, respectively disposed over the first recess and the second recess, wherein each of the first electrode structure and the second electrode structure comprises a corresponding inner metal layer and a corresponding outer metal layer with a corresponding terminal of the coil being disposed therebetween, wherein said corresponding terminal of the coil and said corresponding inner metal layer are disposed in a corresponding recess of said recesses, wherein said corresponding terminal of the coil is electrically connected to said corresponding inner metal layer and said corresponding outer metal layer for electrically connecting with an external circuit.

15. The inductive component according to claim 14, wherein the magnetic core comprises a plate and a pillar, wherein the protrusion portion and the pillar are formed on two opposite sides of the plate.

* * * * *